US006206512B1

(12) United States Patent
Gasso et al.

(10) Patent No.: US 6,206,512 B1
(45) Date of Patent: Mar. 27, 2001

(54) REPLACEABLE INK DELIVERY TUBE SYSTEM FOR LARGE FORMAT PRINTER

(75) Inventors: Xavier Gasso; Antonio Monclus, both of Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/240,039

(22) Filed: Jan. 29, 1999

(51) Int. Cl.[7] ..... B41J 2/175
(52) U.S. Cl. ..... 347/85
(58) Field of Search ..... 347/49, 50, 84, 347/85, 86, 87

(56) References Cited

U.S. PATENT DOCUMENTS

| | | | |
|---|---|---|---|
| 3,821,915 | 7/1974 | Larrable | 83/174 |
| 4,525,088 | 6/1985 | Shipos et al. | 400/621 |
| 4,831,389 | 5/1989 | Chan | 347/85 |
| 5,307,716 | 5/1994 | Onishi et al. | 83/488 |
| 5,369,429 | 11/1994 | Erickson | 347/7 |
| 5,469,201 | 11/1995 | Erickson et al. | 347/85 |
| 5,489,931 | 2/1996 | Shibata et al. | 347/85 |
| 5,650,811 | 7/1997 | Seccombe et al. | 347/85 |
| 5,686,947 | 11/1997 | Murray et al. | 347/85 |
| 5,745,137 | 4/1998 | Scheffelin et al. | 347/85 |
| 5,748,216 | 5/1998 | Scheffelin et al. | 347/87 |
| 5,757,390 | 5/1998 | Gragg et al. | 347/7 |
| 6,003,981 * | 12/1999 | Cameron et al. | 347/85 |

FOREIGN PATENT DOCUMENTS

| | | |
|---|---|---|
| 084973A | 5/1992 | (EP) . |
| 97306158 | 3/1998 | (EP) . |
| 0863016 | 9/1998 | (EP) . |
| 2299778 | 10/1999 | (GB) . |

OTHER PUBLICATIONS

ENCAD Corporation, Novajet ProE, User's Guide, Nov. 1995.

* cited by examiner

*Primary Examiner*—N. Le
*Assistant Examiner*—Anh T. N. Vo
(74) *Attorney, Agent, or Firm*—Roth & Goldman

(57) ABSTRACT

A replaceable ink delivery tube system for a large format ink jet printer includes four flexible ink delivery tubes arranged in parallel and each permanently connected at one end to a printhead connector and at the other end to an off-axis ink reservoir receiving connector which, when mounted in the printer, is accessible from the front side of the printer to insert and remove four separate ink reservoirs from the ink reservoir connector. Lockouts are provided at both the printhead connector and ink reservoir connector ends of the replaceable delivery tube system to ensure that only ink reservoirs and printheads of the correct type can be attached to the replaceable system. The replaceable ink delivery tube system enables rapid modification of a printer to accept either pigment based or dye-based inks and the lockouts prevent pigment based ink reservoirs and printheads from being connected to a dye-based ink replaceable tube system or vice versa. Although access to the rear side of the printer is required for replacement of the ink delivery tube system, the off-axis ink reservoirs and onboard printheads are all replaceable from the front side of the printer.

37 Claims, 16 Drawing Sheets

100
58
50
52
54
56
108
30
102
104
110
111
112
114
116

50
58
100
B
Y
M
C
111
110
112
113
123
122
115
114
116
117
104
125
124
121
120

REPLACEABLE INK DELIVERY TUBE SYSTEM FOR LARGE FORMAT PRINTER

CROSS REFERENCE TO RELATED APPLICATIONS, IF ANY

None.

BACKGROUND OF THE INVENTION AND PRIOR ART

The present invention relates to the art of computer driven printers, particularly, large format color ink jet printers. Printers of this type have a printhead carriage which is mounted for reciprocal movement on the printer in a direction orthogonal to the direction of movement of the paper or other medium on which printing is to take place through the printer. The printer carriage of a color printer typically has four removable electric or thermal ink jet printheads mounted thereon. Each of the printheads contains a supply of ink which, for large scale printers, is generally inadequate due to the large volumes of ink which are required as compared with the ink supply requirements of desk top printers. Consequently, various means have been proposed for continuously or periodically refilling the carriage-borne printheads with ink. These systems fall into two categories. The first comprises offboard or off-axis ink reservoirs which are continuously connected to the carriage-borne or onboard printheads by flexible tubes. The second comprises a "take a gulp" system in which the printhead carriage is periodically moved to one end of its path of travel where it is then connected with off-axis ink reservoirs to fill the onboard printheads. This "take a gulp" system is disclosed in Hewlett-Packard's Designjet 2000 printer referred to in U.S. patent application Ser. No. 08/805,861 filed Mar. 3, 1997 and published in European Patent Publication No.0863016 on Sep. 9, 1998.

Large format printers are expensive pieces of equipment which preferably should be capable of using different types of ink without significant modification of the printer. The different ink types may for convenience be broadly referred to as indoor ink and outdoor ink, meaning ink intended to be used for production of drawings, posters, and other printed material which may be displayed outdoors or indoors. Outdoor ink is pigment based, i.e. containing a plurality of discrete undissolved pigment particles suspended in a fluid carrier. Dye-based ink has a lower degree of optical density and permanence but is less expensive. Since pigment based inks and dye-based inks are incompatible with each other, a system is desired which enables the use of either type of ink in a printer without cross-contamination of the printer inks by each other.

Further, in color printers four separate colors of ink are usually employed comprising black and three primary or mid-primary colors such as cyan, magenta and yellow. In color ink printers provision must also be made to ensure that neither incorrect types of ink nor incorrect colors of ink can inadvertently be used in the system.

SUMMARY OF THE INVENTION

The present invention provides a replaceable ink delivery tube system for a large format printer comprising:

a) at least one flexible ink delivery tube;

b) a printhead connector affixed to an ink delivery end of said tube; and c) an ink reservoir connector affixed to an ink supply end of said tube; said printhead connector and said ink reservoir connectors each having lockout means thereon to permit connection of said connectors only to preselected complementary mating ink reservoirs and printheads.

DESCRIPTION OF THE PREFERRED EMBODIMENT

Figure 1:
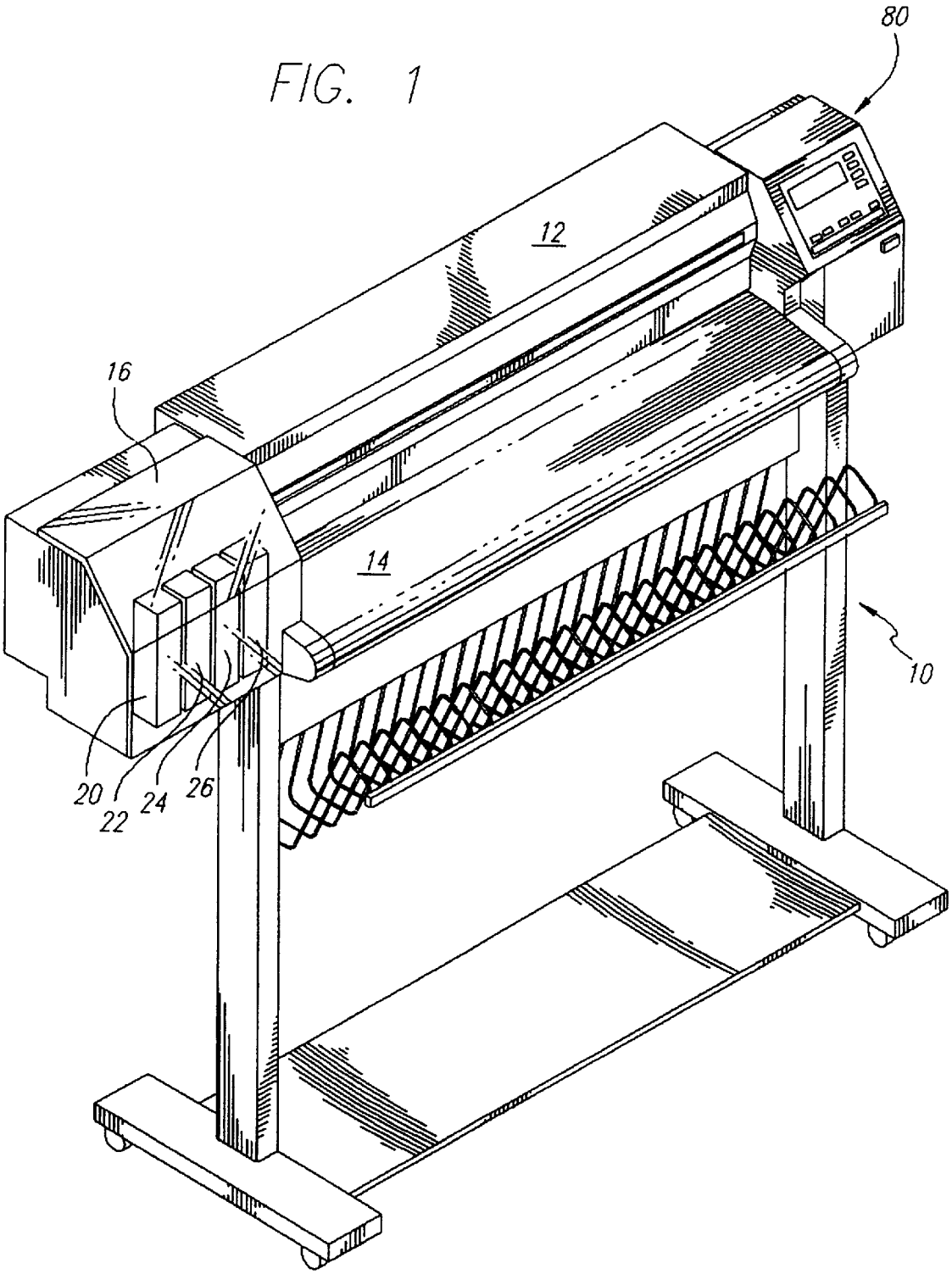
FIG. 1 is a perspective view of a large format printer in which the present invention is useful.

FIG. 1 shows a large format printer 10 of the type which includes a transversely movable printhead carriage enclosed by a plastic or metal hinged cover 12 which extends over a generally horizontally extending platen 14 over which printed media is discharged. At the left side of the platen is a transparent hinged cover 16 which contains four removable ink reservoirs 20, 22, 24, 26 which, through a removable flexible tube arrangement to be described, supply ink to four inkjet printheads mounted on the moveable carriage.

Figure 2:
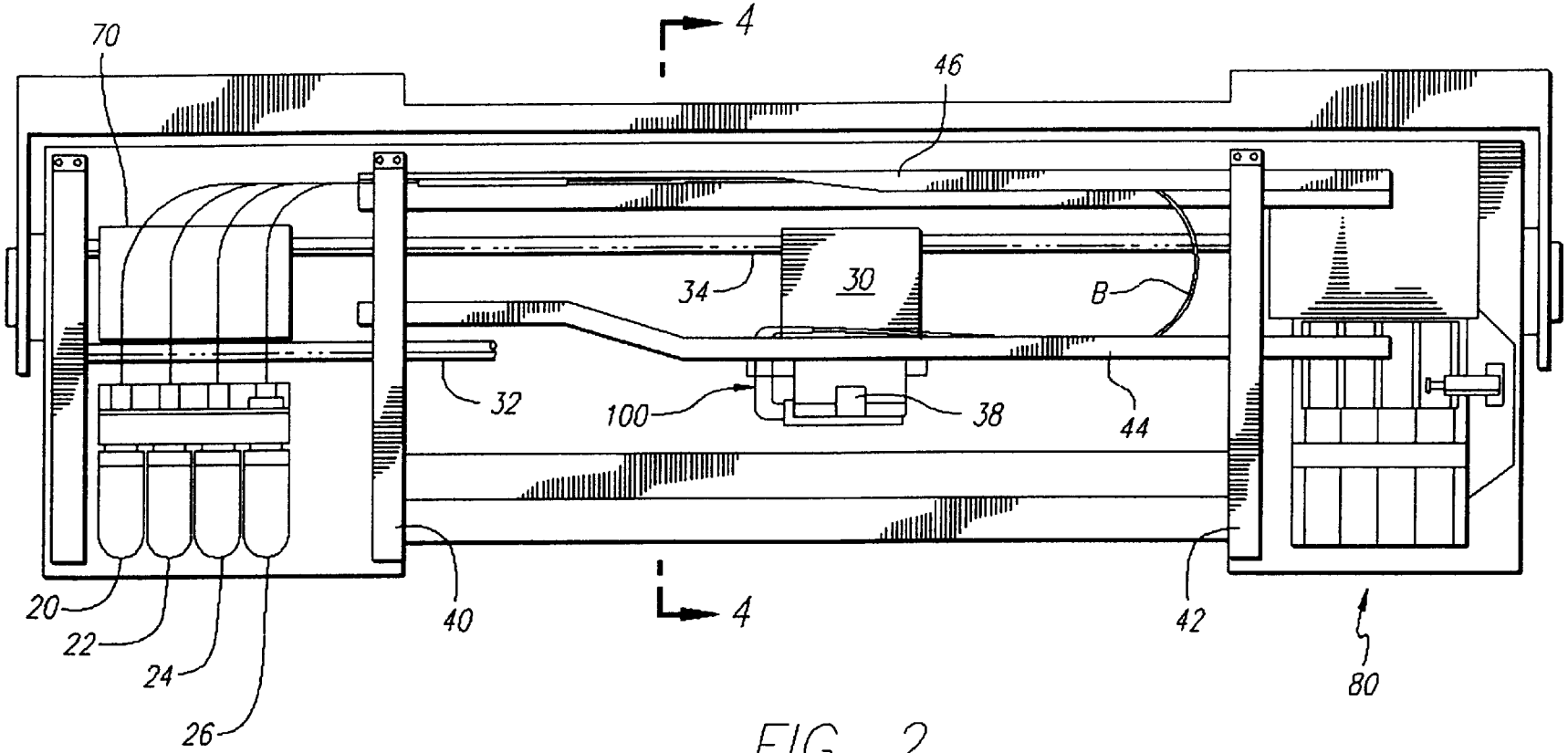
FIG. 2 is a top plan view of the printer with its cover removed to show the printhead carriage and ink tube guides and supports.
Figure 7:
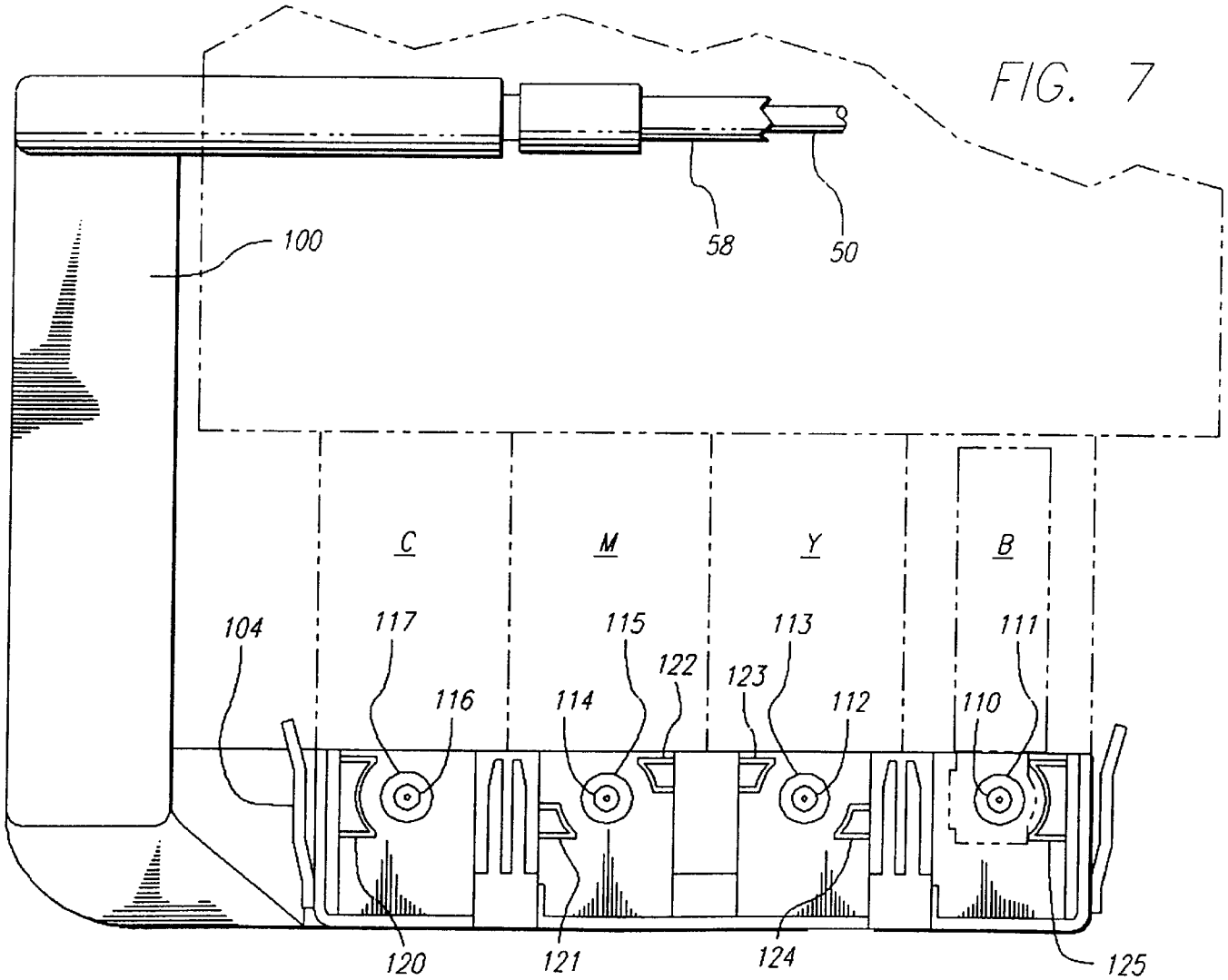
FIG. 7 is a top plan view of the printhead connector showing printhead lockouts therein with portions of a printhead carriage shown in phantom.

In the plan view of FIG. 2 in which the carriage cover 12 has been removed, it is seen that the printhead carriage 30 is mounted on a pair of transversely extending slider rods or guides 32, 34 which in turn are rigidly affixed to the frame of the printer. Also rigidly affixed to the frame of the printer are a pair of tube guide support bridges 40, 42 from which front and rear tube guides 44,46 are suspended. The printhead carriage 30 has a pivotal printhead holddown cover 36 fastened by a latch 38 at the front side of the printer which securely holds four inkjet printheads, one of which is shown in FIG. 7 in place in stalls C, M, Y, B on the carriage. The front tube guide 44 is angled near the left bridge support 40 to provide clearance for opening the printhead cover when the carriage is slid to a position proximate the left side of the platen 14 so that the printhead holddown cover 36 can be easily opened for changing the printheads.

A replaceable ink delivery tube system described in more detail below conveys ink from the four separate ink reservoirs 20, 22, 24, 26 at the left side of the printer through four flexible ink tubes 50, 52, 54, 56 which extend from an ink reservoir connector 70 through the rear and front tube guides 44, 46 to a printhead connector 100 which is releasably affixed to the carriage 30.

At the right side of the printer is a printhead service station 80 at which the printhead carriage 30 may be parked for servicing such as wiping, spitting or priming the printheads.

Figure 3:
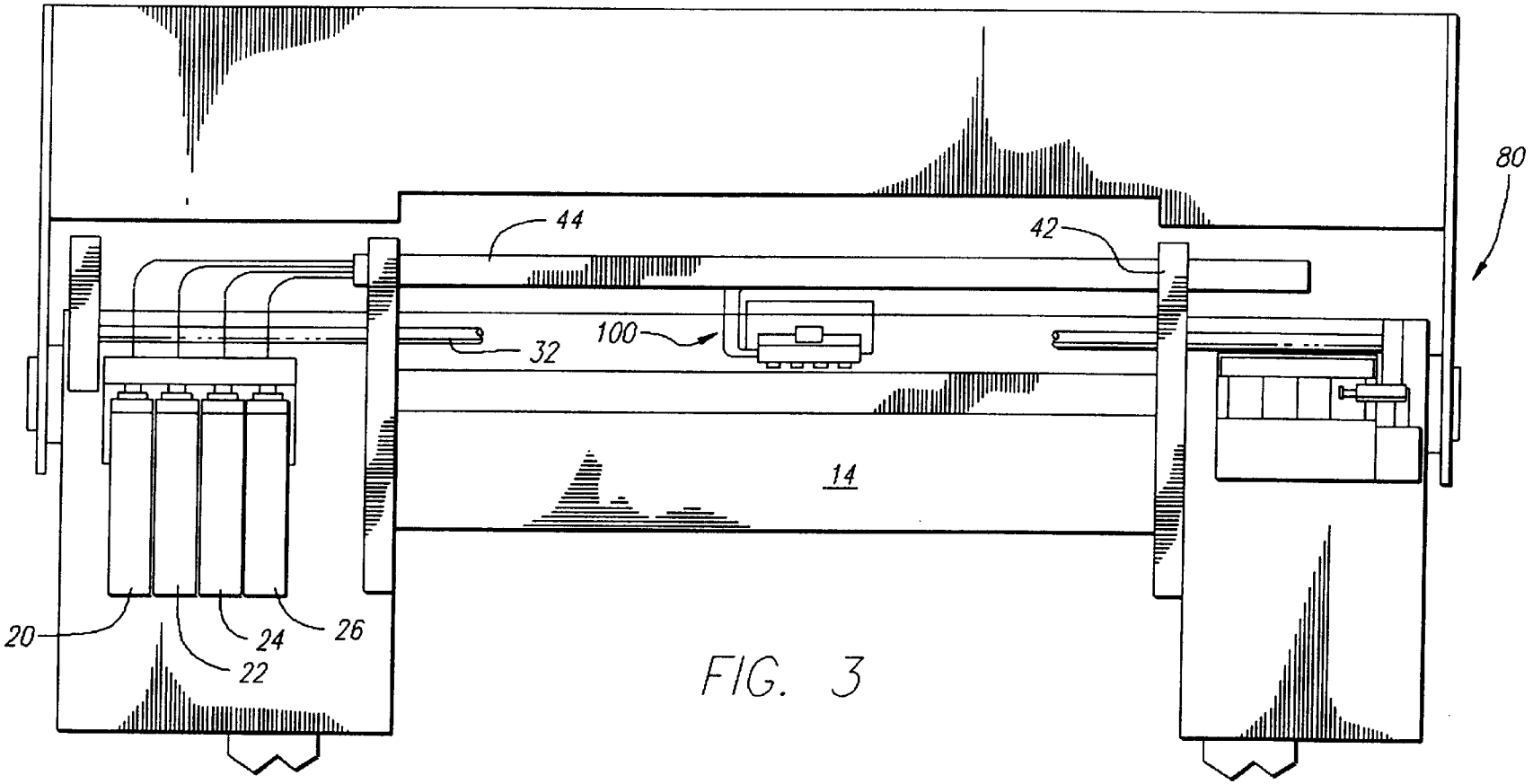
FIG. 3 is a front elevation view of the upper portion of the printer with cover removed to show the printhead carriage and attached printhead connector tubes.
Figure 11:
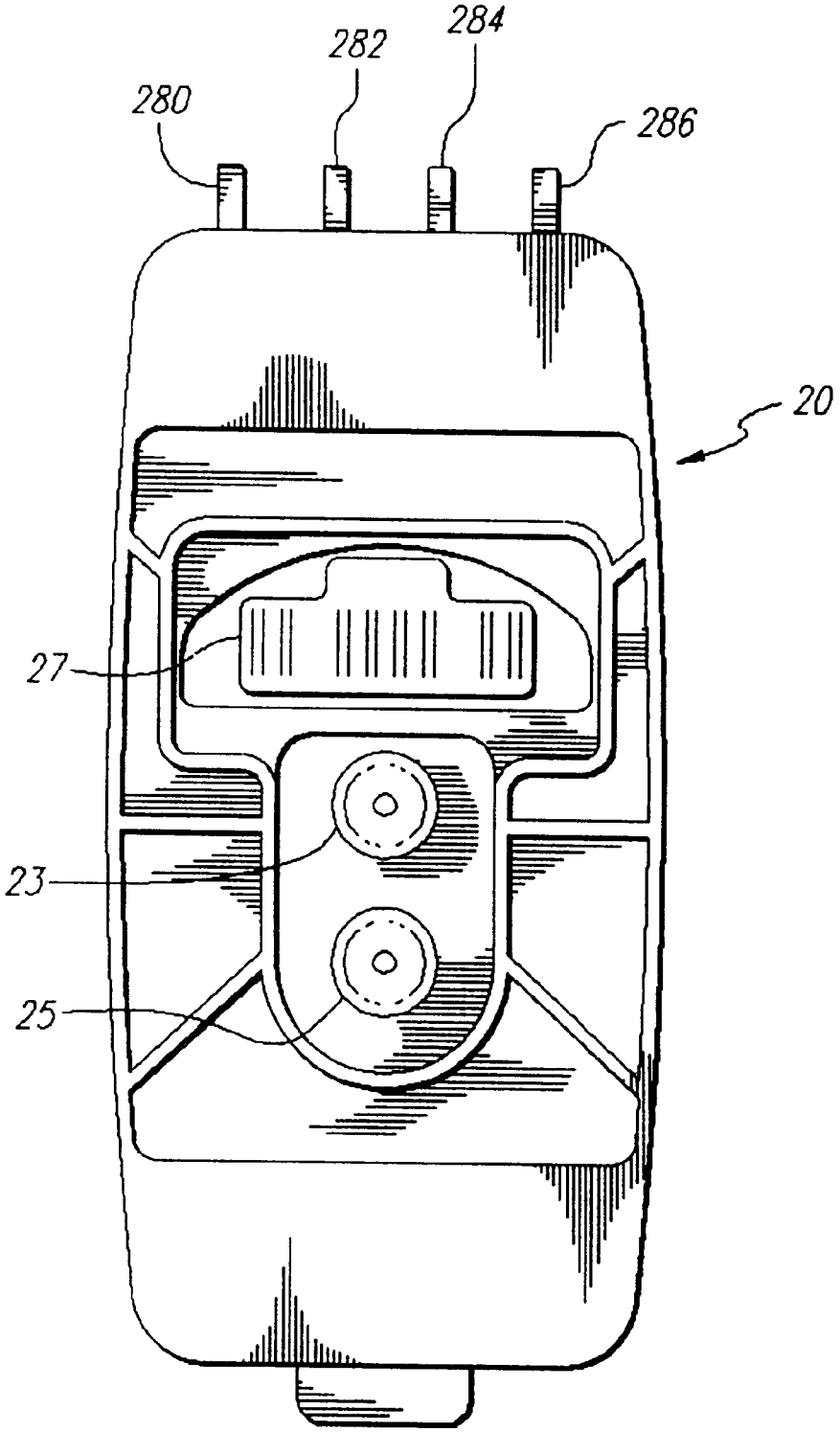
FIG. 11 is an elevation of the ink connection end of an ink reservoir having a fin configuration complementary with the fin configuration of the reservoir connector lockout of FIG. 10.

As seen in FIG. 3, each of the four ink reservoirs 20, 22, 24, 26 is easily accessible from the front of the printer when the reservoir cover 16 (seen in FIG. 1) is open so that the reservoirs can be easily removed to be refilled or replaced with new reservoirs. As is known in the art, three of the reservoirs each contain a different base color of ink such as cyan, magenta and yellow and the fourth reservoir contains black ink so that a high number of colors can be produced as desired during printing. FIG. 11 shows an ink connector 23, an air connector 25 and an electrical connector 27 on the front end of an ink reservoir 20. The other reservoirs are similarly constructed.

Figure 4:
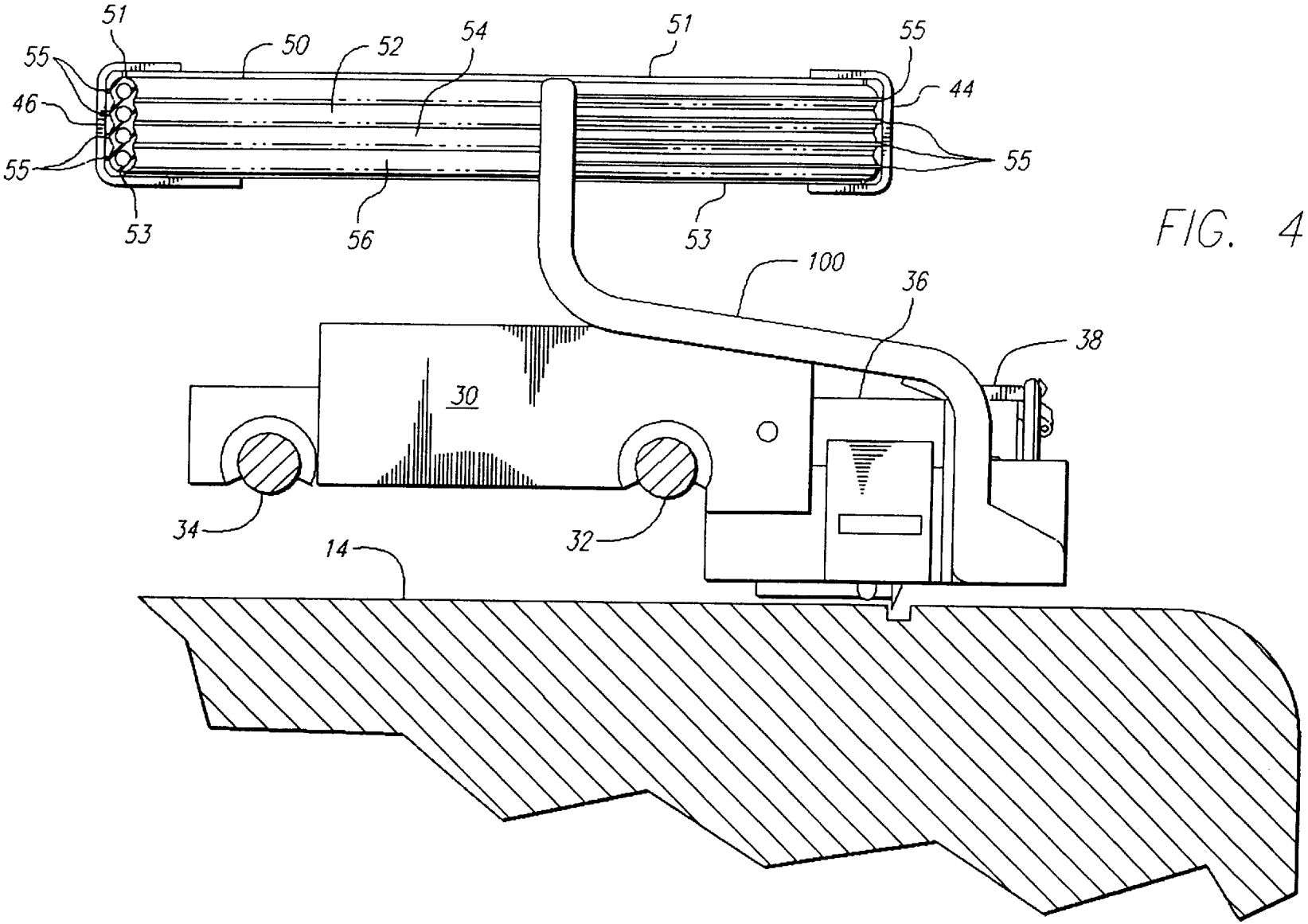
FIG. 4 is a vertical cross-section through the relevant portions of the printer showing the relative position of the carriage, the tube guide system and the ink delivery tubes and carriage connector.

As shown in the cross-sectional view of FIG. 4, the front and rear tube guides 44, 46 are of channel configuration having a lower support surface which extends in a common horizontal plane for supporting the ink delivery tubes 50, 52, 54, 56 at all points with the exception of the reverse bend B (FIG. 2) in the tubes to the right of the printer carriage 30.

Figure 3A:
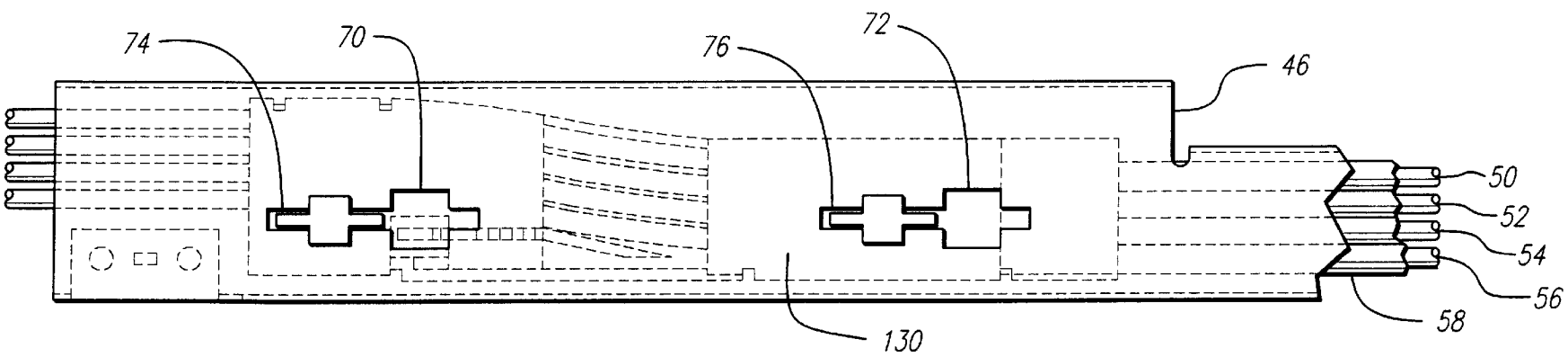
FIG. 3A is a partial elevation view of the rear tube guide showing a tube clip affixed thereto.

The replaceable ink delivery tube system is broadly comprised of the four flexible ink delivery tubes 50, 52, 54, 56 which are all permanently connected at one end to the printhead connector 100 which is a relatively rigid plastic part best seen in FIGS. 4–7 and, at the other end, to the reservoir connector 70 which is another relatively rigid plastic part best seen in FIGS. 9 and 12–15. The ink delivery tubes are preferably made of a linear low density polyethylene. A protective sheath 58 encloses the flexible ink tubes between their permanent connection to the printhead connector 100 and a rigid plastic tube clip 130 which fastens the ink tubes to the rear tube guide 46 at the location shown in FIG. 3A near the left side of the printer. The protective sheath 58 preferably includes wear resistant lubricious ribs 51, 53 on the top of the upper tube 50 and at the bottom of the lower tube 56 and ribs 55 on the sides of all four tubes 50, 52, 54, 56 which face the front and rear tube guides 44, 46. The ribs 51, 53, 55 are preferably made from polypropylene containing about 5% aramid fibers and 20% polytetrafluoroethylene (TEFLON). The material of the sheath 58 is preferably a polypropylene and EPOM compound which is both flexible and fatigue resistant. The above combination of materials for the sheath and ribs has been found to be considerably more quiet than prior art flexible ink deleivery tube systems.

Apertures cut into the vertical wall of the rear tube guide 46 receive mating bayonet clips 132, 134 on the rear side of the tube clip 130 so that the tube clip may be slid to the right or the left to easily connect or disconnect the clip 130 from the rear tube guide 46.

Figure 5:
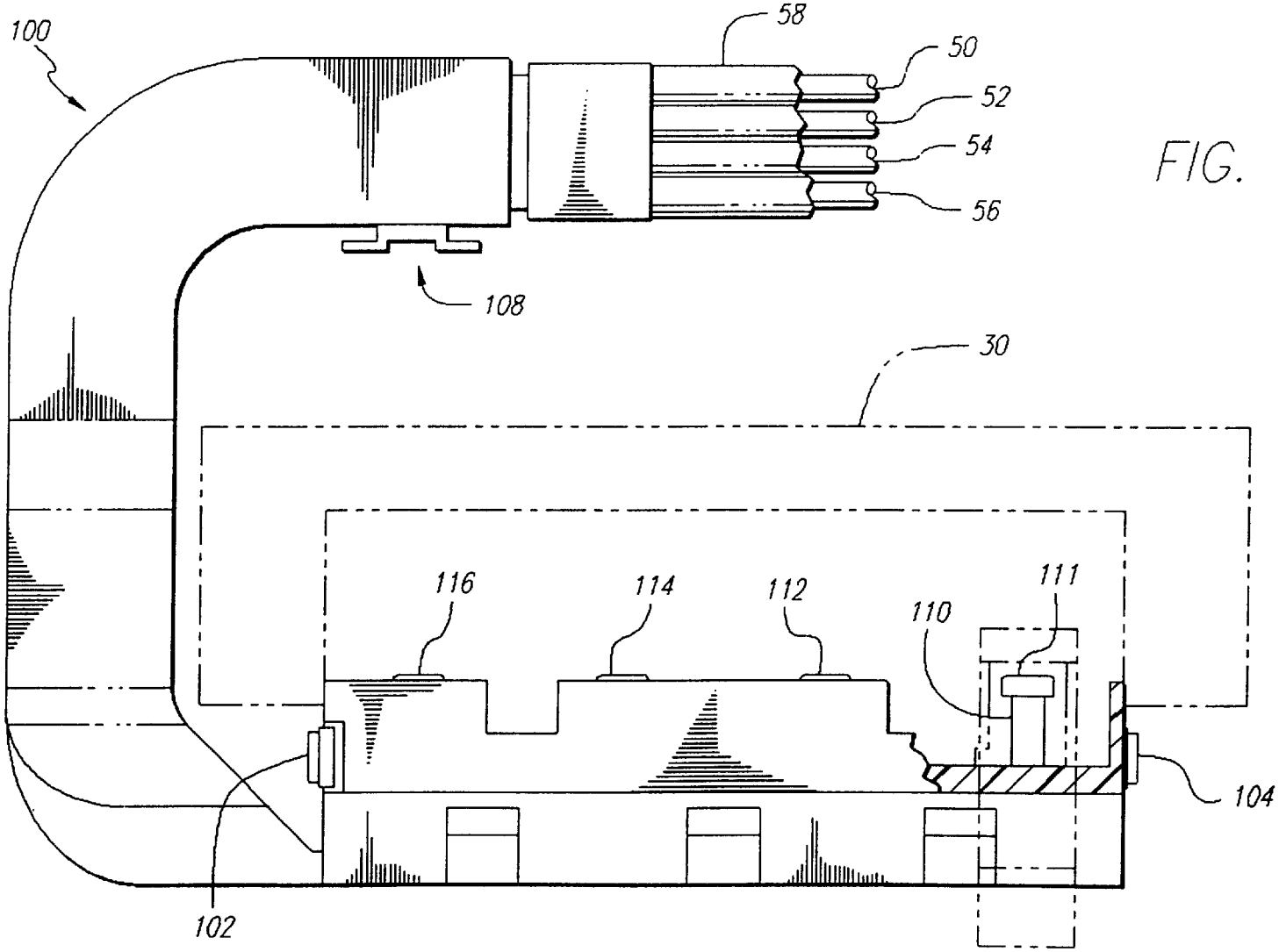
FIG. 5 is a front elevation view of the printhead connector, partly broken away, with a printhead carriage being shown in phantom.
Figures 6, 6A:
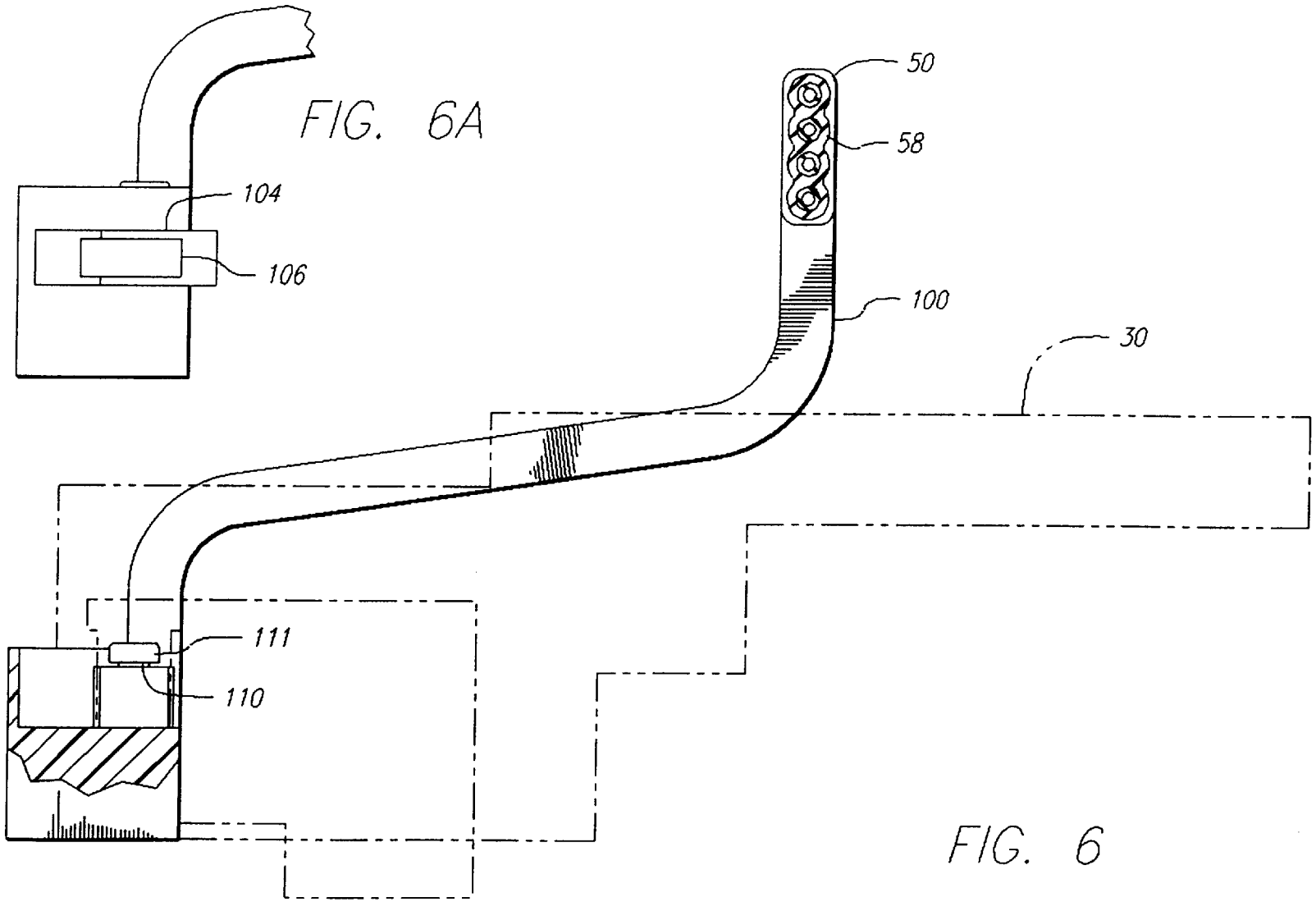
FIG. 6 is a right side elevation view of the printhead connector, partly broken away, with a printhead carriage shown in phantom.
FIG. 6A is a partial right side elevation view like FIG. 6 of the printhead connector showing a resilient carriage connection tab.

The printhead connector 100 comprises a plastic part which is rigid as compared with the flexible ink delivery tubes and sheath and extends from the left end of the ink delivery tubes guided in front guide 44 to which the connector 100 is permanently affixed downwardly and thence towards the front of the printer and again downwardly and thence to the right where it is affixed to the printhead carriage as seen in FIGS. 4–6. The printhead connector 100 has four ink tube channels therein respectively guiding one each of the ink delivery tubes 50, 52, 54, 56 in a curved plane until the ink delivery tubes each terminate in an ink delivery connector end 110, 112, 114, 116 which extends generally upwardly for engagement with one of four separate printheads mounted on the carriage 30. The ink delivery connector ends 110, 112, 114, 116 are resilient to provide slight lateral movement to facilitate connection and have metal collars 111, 113, 115, 117 which are affixed thereto, the connectors comprising female connectors which mate with the complementary configured male connectors on each of the printheads to provide a flexible but fluid tight connection as the printheads are inserted vertically downwardly into the stalls C, M, Y, B on the carriage 30. The printhead connector is easily affixed to and removed from the carriage by squeezing a pair of resilient finger tabs 102, 104, as seen in FIGS. 5 and 7 to disengage apertures 106 in the free ends of the tabs 102, 104 from mating projections on the sides of the carriage 30 when the printhead connector 100 is to be detached from the carriage. Attachment of the printhead connector to the carriage is made by horizontally sliding the printhead connector 100 toward the rear of the printer so that a guide 108 on the connector 100 is received in a mating guide (not shown) on the carriage 30 as the printhead connector is moved toward the rear of the printer, the resilient finger tabs 102, 104 automatically bending outwardly due to camming edges on the ends thereof which engage complementary camming edges on the projections on the printhead carriage which are then received in the apertures 106 in the resilient finger tabs as seen in FIG. 6A.

Figure 8:
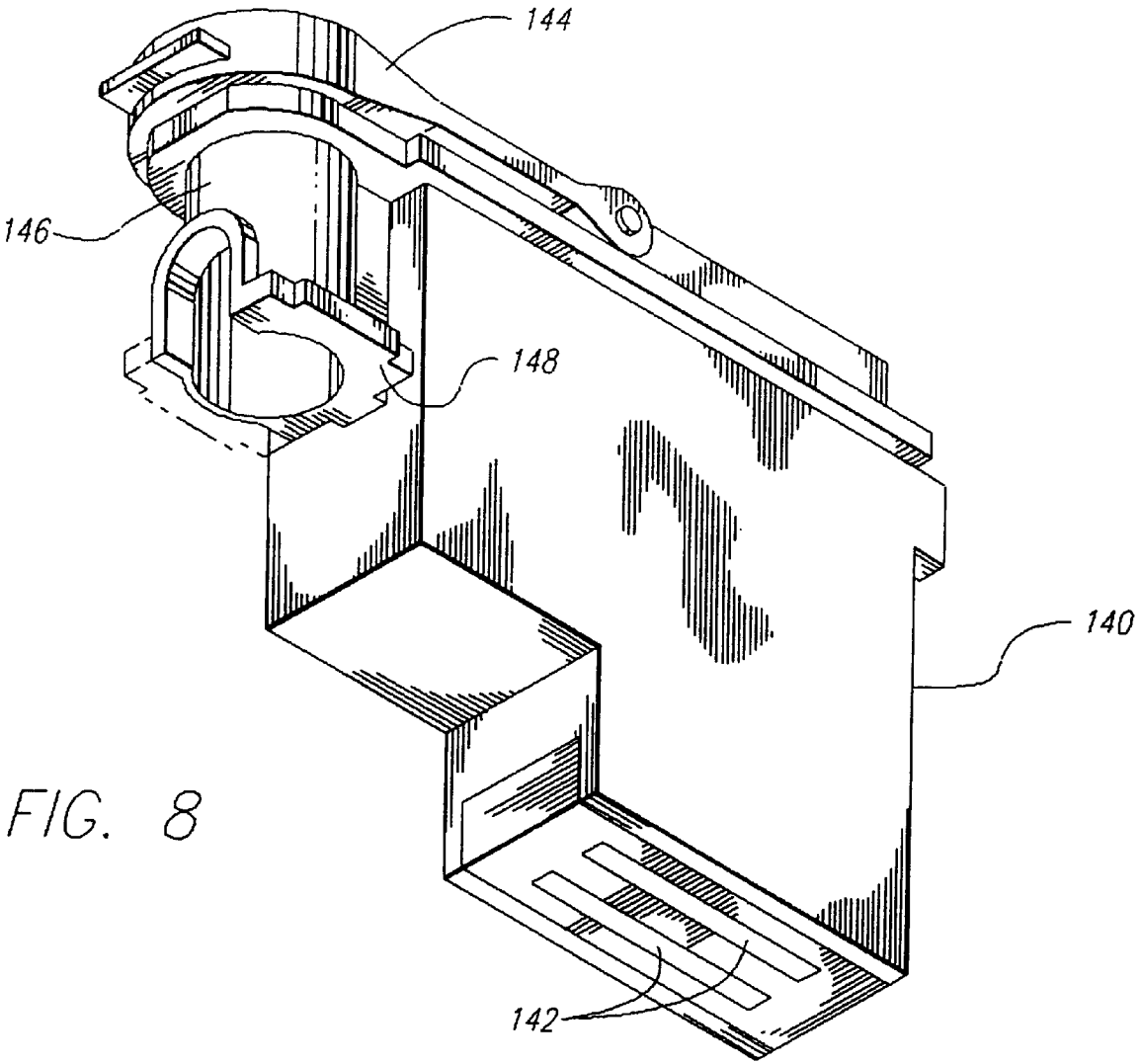
FIG. 8 is a perspective view from below of a printhead showing a lockout tab configuration which mates with the cyan color slot of the printhead connector.

Referring now to FIGS. 7 and 8, four printheads 140 (one of which is shown in phantom in FIG. 7) are received in the four separate stalls C, M, Y, B on the carriage 30 and have ink reception ports which respectively mate with ink delivery connectors 110, 112, 114, 116 on the printhead connector 100. Each stall has a different printhead lockout configuration comprised of various vertically extending lockout posts 120–125 formed on the printhead connector 100 in different positions around the ink delivery connector ends 110, 112, 114, 116 so that each stall is different and can only be mated with a printhead 140 of complementary configuration. By way of illustration only, the left stall C is configured to receive a printhead containing cyan colored ink. The adjacent stall M is configured to receive magenta, the next stall Y to the right is configured to receive yellow ink and the stall B at the right side of the connector 100 is configured to receive a printhead containing black ink.

FIG. 8 shows a printhead 140 configured to be received in the cyan stall of the printhead connector 100. The printhead 140 includes two rows downwardly directed inkjet nozzles 142 and a pivotally mounted handle 144 at the top for removing the printhead 104 from the carriage 30. The cyan ink delivery connector 110 on the printhead connector is received in a generally vertically extending ink receiving tube 146 on the cyan printhead. Proximate the lower end of the ink receiving tube 146 is a lockout collar 148 integrally formed with the printhead 140 with a portion shown in phantom which has been broken off or otherwise removed at the factory so that the cyan configured printhead 140 can only be receivable in the cyan stall C of the printhead connector 100 to properly connect the ink delivery connector end 116 tube with the cyan printhead 140. It will be appreciated that printheads may be mass produced with frangible collars 148 extending generally all the way around the ink receiving tube 146 and that selected portions of the collars 148 can be easily removed at the factory to thus create cyan, magenta, yellow and black printheads each having different configurations which are uniquely receivable only in the appropriate stalls of the printhead connector 100. The partially removable or frangible collars 148 may be removed at selected locations whereby the remaining portions of the collars 148 are receivable only in the mating stalls on the printhead connector. Alternatively, it will be appreciated that the printhead connector lockout posts 120, 125 may be constructed so that they are easily broken off or otherwise removed in selected areas for mating with appropriately configured printheads.

The replaceable ink delivery tube system of the present invention comprised of the flexible ink delivery tubes 50–56 and printhead connector 100 is completed by the ink reservoir connector 70 (FIGS. 9 and 12–15) which is permanently affixed to an ink supply end of the ink delivery tubes. The reservoir connector comprises a plastic frame 72 having guide channels 73 which mate with guide rails on the printer frame and a vertically extending flange 74 to which a printed circuit board PCB, not part of the present invention, is rigidly attached. The frame 72 includes a pair of vertically extending sides 76, 78 and defines four parallel connector module stalls separated by vertically extending divider walls 80, 82, 84. The frame is open at the front and rear sides so that the ink delivery ends of ink reservoirs 20, 22, 24, 26 may be received in the stalls from the front side of the printer. The front side of the reservoir connector 70 seen in FIG. 9 and shows modules, described below, having ink delivery inlets 50*i*, 52*i*, 54*i*, 56*i*, air connections 90, 91, 92, 93 and electrical connectors 94, 95, 96, 97 which mate with like connections on the reservoirs, the modules being mounted in the module stalls and extending through the stalls in the frame 72 to the rear side of the printer.

Four reservoir connector modules 200, 202, 204, 206 are resiliently mounted in each of the four stalls of the frame 72 such that the four modules are forwardly and rearwardly moveable with respect to the frame and slightly laterally moveable with respect to the frame under the influence of a pair of compression springs 208, 210 extending between each module and spring seats on the frame 72 to permit the modules to readily connect to and disconnect from the ink reservoirs 20, 22, 24, 26 which are manually inserted from the front of the printer. Each module ink port 90, 91, 92, 93 receives ink from one ink reservoir 20, 22, 24, 26, and the air connections 90, 91, 92, 93 deliver compressed air to the reservoirs.

Figure 12:
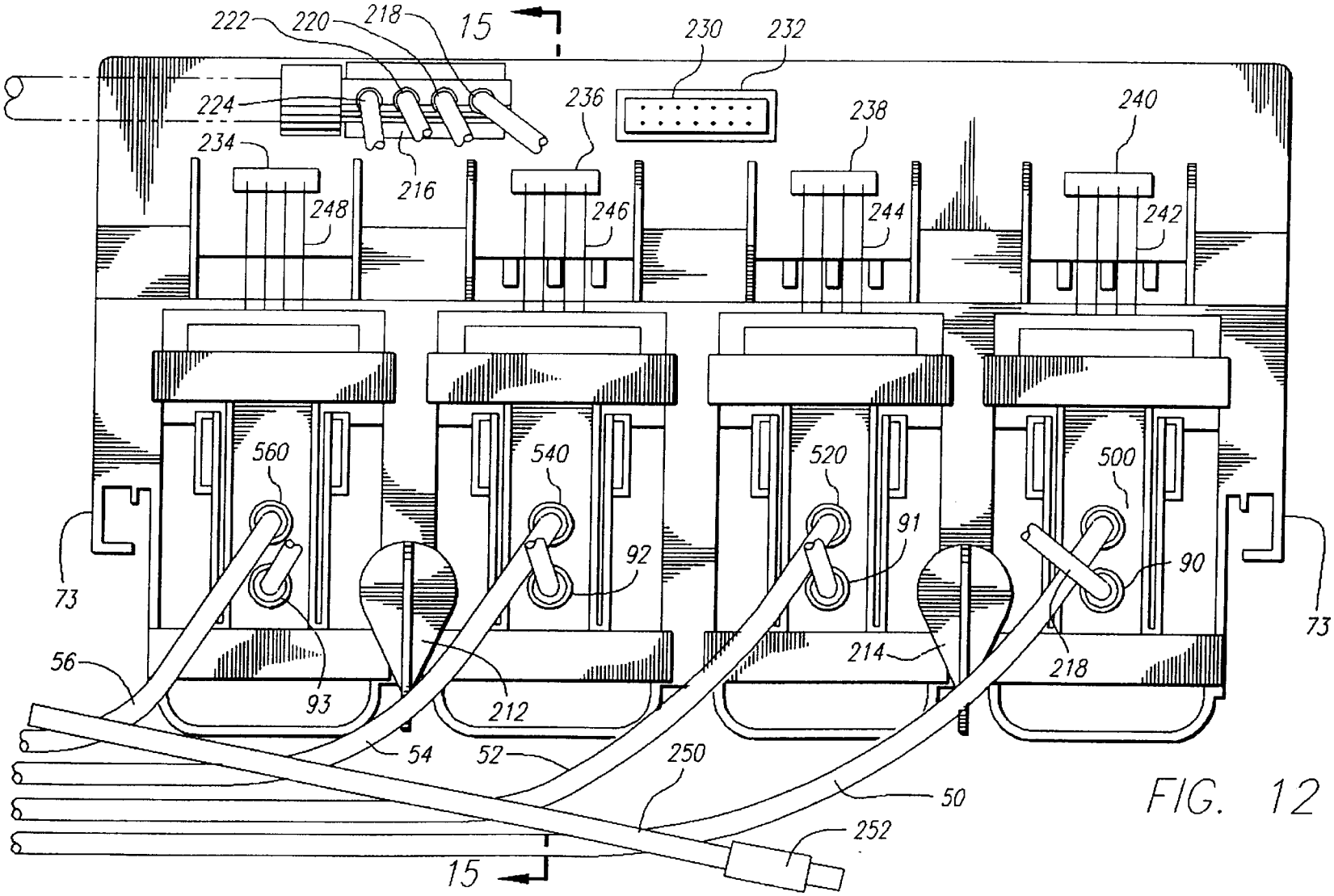
FIG. 12 is a rear elevation view of the reservoir connector.
Figure 13:
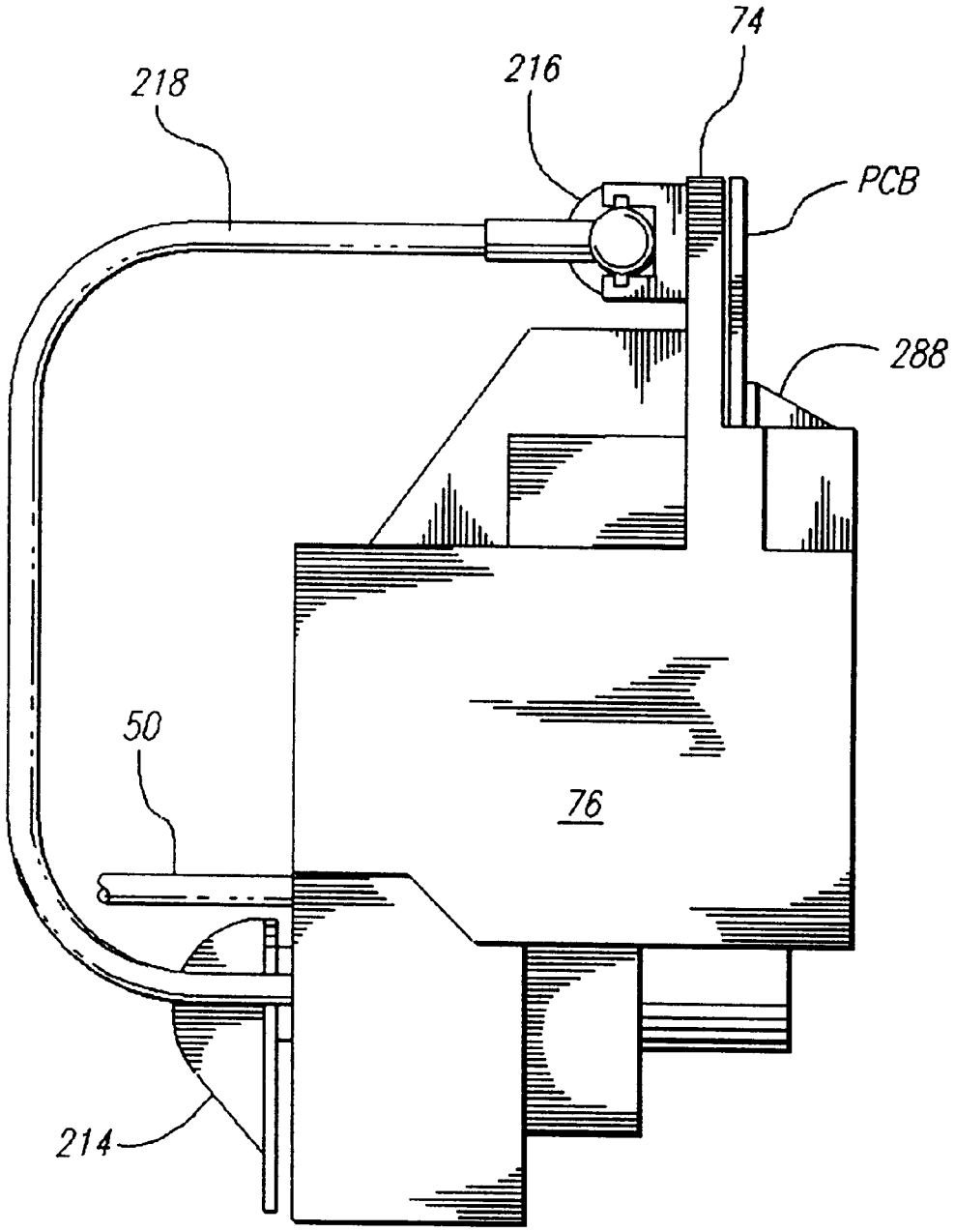
FIG. 13 is a left side elevation view of the reservoir connector, the right side view being a mirror image thereof.
Figure 14:
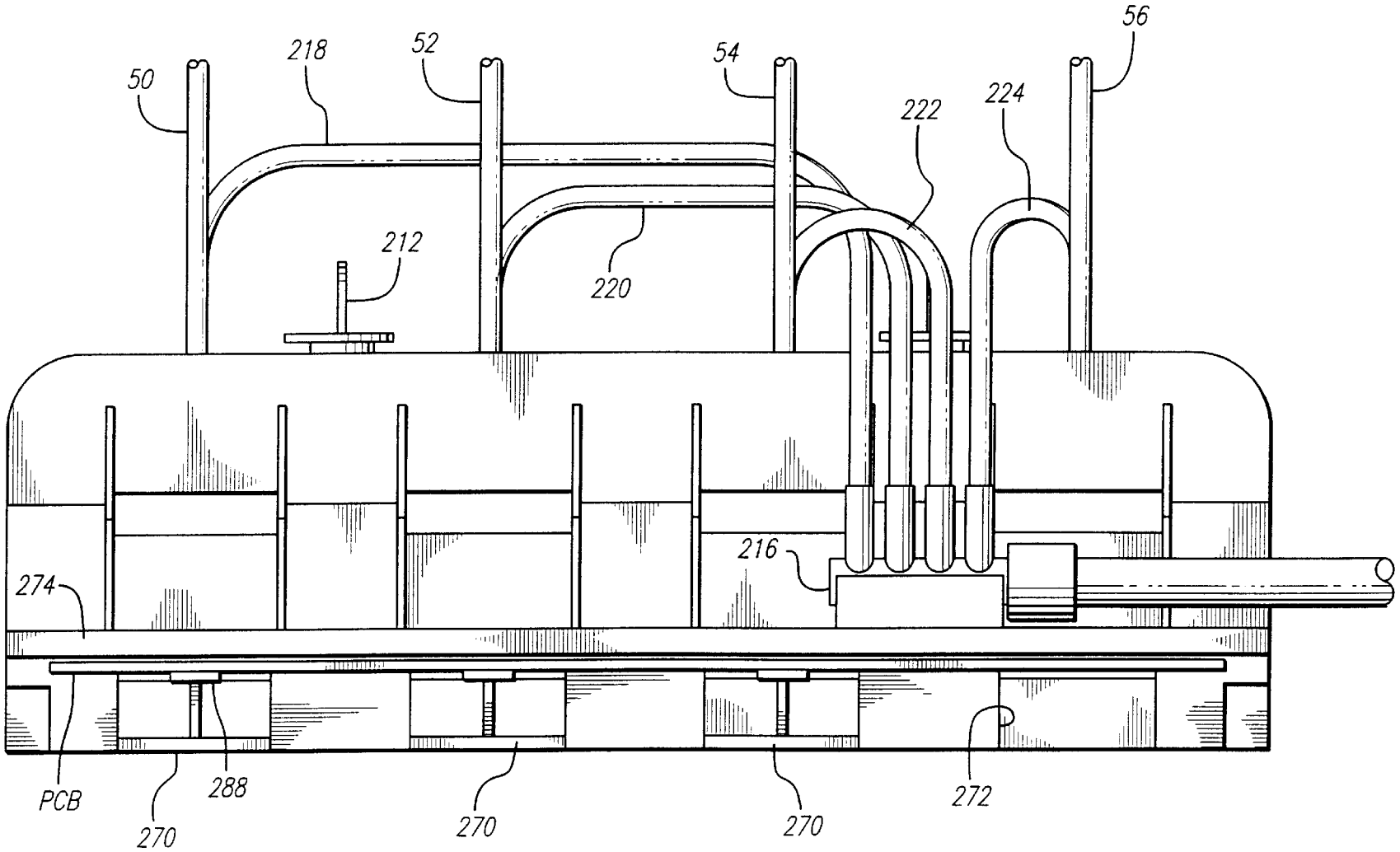
FIG. 14 is a top plan view of the reservoir connector.
Figure 15:
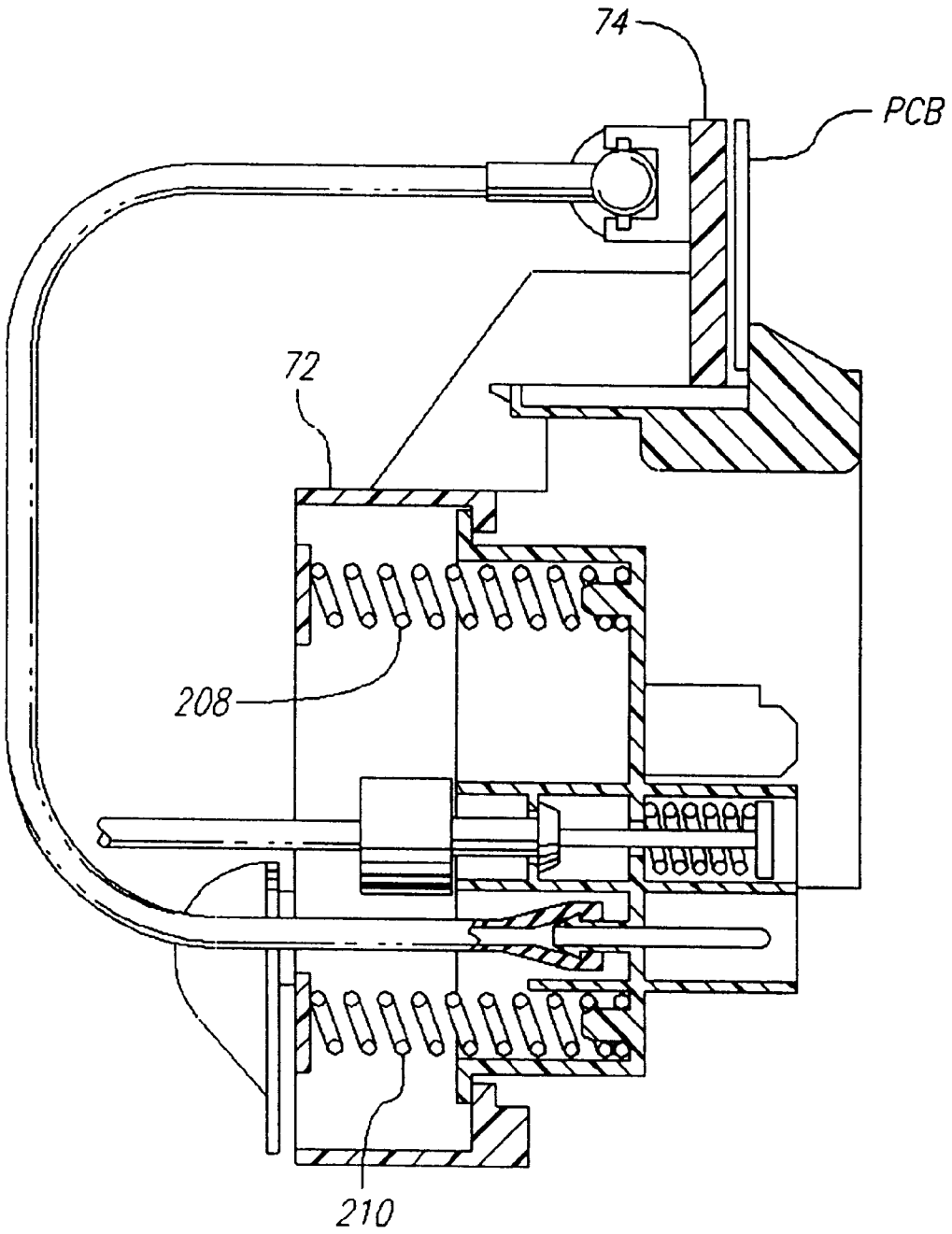
FIG. 15 is a vertical cross section of the reservoir connector showing a connector module resiliently mounted therein.

The rear side of the reservoir connector 70 as seen in FIG. 12, includes a pair of quick release twist connectors 212, 214 which are easily gripped between the thumb and fore finger which can be rotated as desired to rotate locking shafts received in apertures in the printer frame to connect and disconnect the reservoir connector 70 from the printer frame. An air delivery manifold 216 is mounted on the rear of the upwardly extending flange 74 and includes a quick release connector for connecting and disconnecting the manifold 216 to a flexible air supply line which delivers air through four tubes 218, 220, 222, 224 to the modules 200, 202, 204, 206 to pressurize each of the four ink reservoirs when connected to the modules to cause the ink reservoirs to deliver ink under pressure through the ink delivery connections 50*i*, 52*i*, 54*i*, 56*i* and the four ink supply tubes 50, 52, 54, 56 which are respectively connected to ink supply outlets 50*o*, 52*o*, 54*o*, 56*o* on the rear side of the modules. Also shown is a a main electrical connector 230 extending through an aperture 232 in the flange 74 which connects to the circuit board and four electrical connections 234, 236, 238, 240 of conductors 248, 246, 244, 242 extending from the circuit board through the frame 72 to the connectors 94–97 on the front of the modules. Disconnection of the main air supply line from the manifold 216 and disconnection of an electrical conductor strip from the main electrical connector 230 is quickly made by from the rear side of the printer so that the entire reservoir connector including the permanently connected ink delivery tubes 50, 52, 54, 56 can be removed from the printer merely by rotating the quick release connectors 212, 214. A rigid plastic tube clip 250 having a bayonet connector 252 which is readily slidably received in and removed from an aperture in the printer frame is also provided to hold the ink delivery tubes 50, 52, 54, 56 in the proper spaced relationship to each other proximate the reservoir connector 70.

Figure 9:
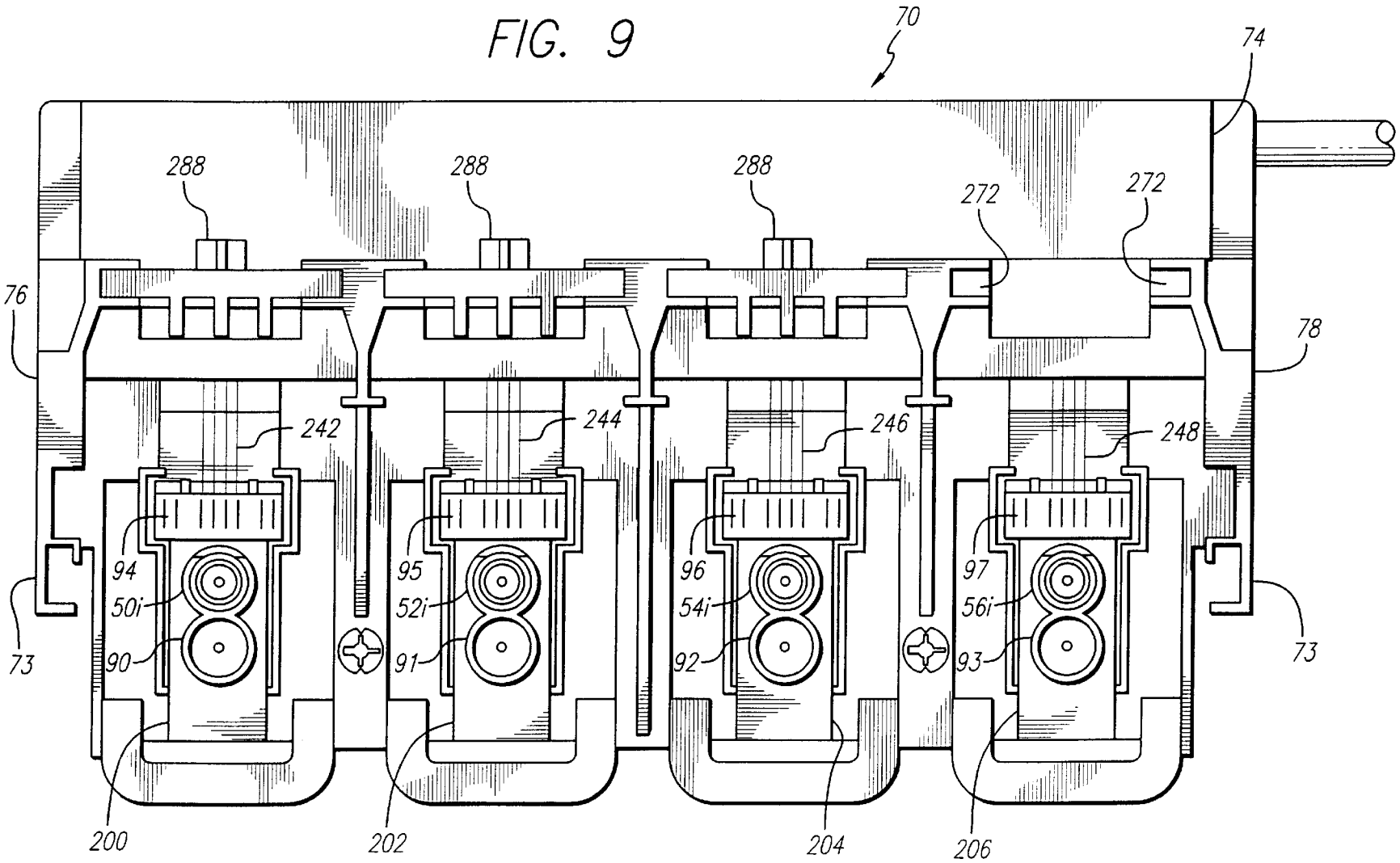
FIG. 9 is a front elevation view of the reservoir connector with one reservoir lockout removed.
Figure 10:
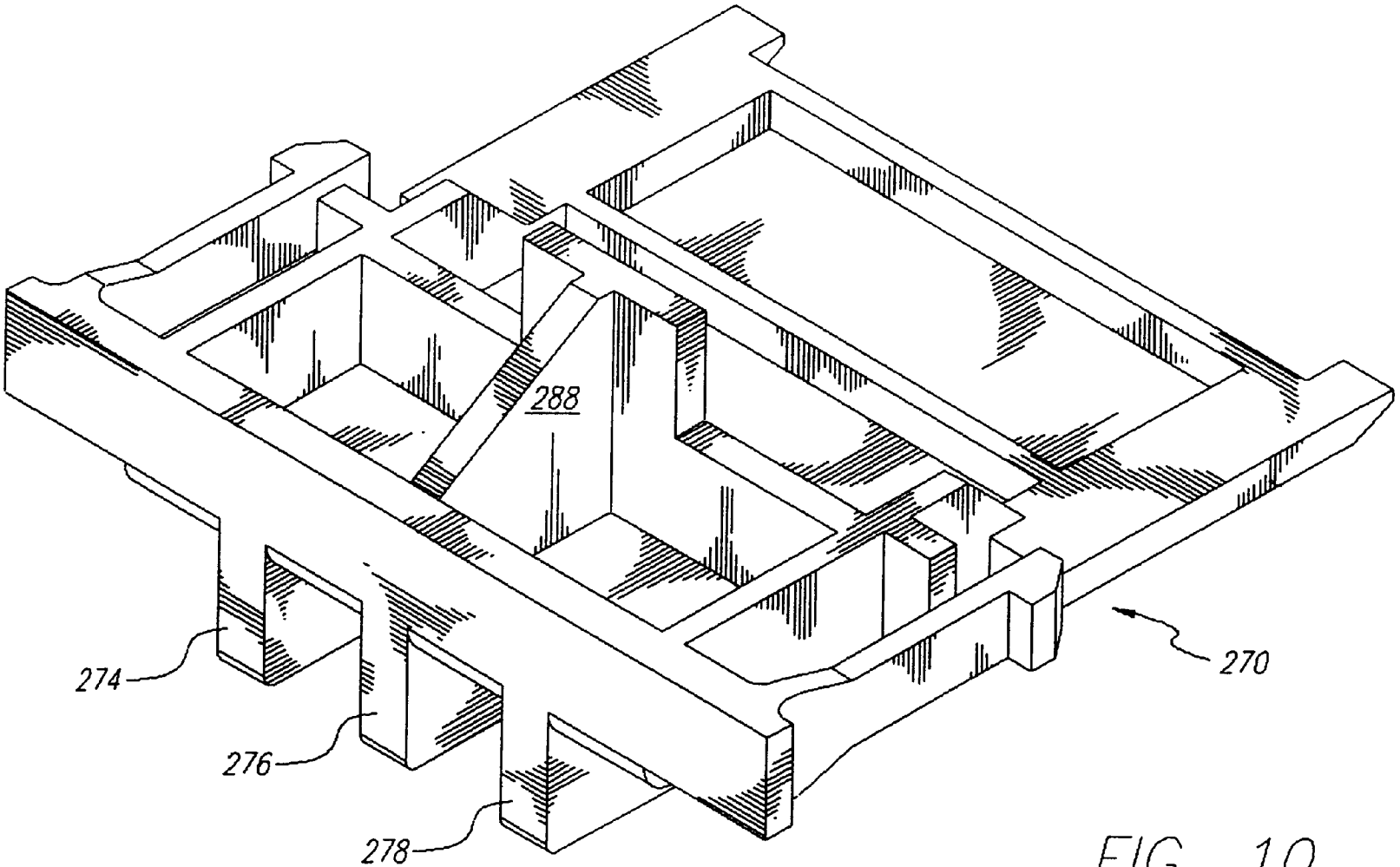
FIG. 10 is a perspective of a lockout receivable in the reservoir connector having a fin configuration complementary with the fin configuration on an ink reservoir.

Ink reservoir lockouts 270 are provided to ensure that ink reservoirs are containing only one type of ink, for example pigment based ink, can be received in the reservoir connector. In the preferred embodiment, these lockouts take the form of four separate removable members 270 slideably received in slots 272 in the top portion of the frame 72 above the four modules. In the configuration shown, each lockout 270 has three horizontally spaced downwardly extending fins 274, 276, 278 which mate with ink reservoirs having four horizontally spaced upwardly extending fins 280, 282, 284, 286 (FIG. 11) to ensure that reservoirs containing one type (not color) of ink only, e.g. pigment based ink rather than dye based ink, can be received in the frame 72. Separate lockouts (not part of this invention) are also provided near the front end of the reservoir stalls in the printer frame to ensure that reservoirs containing only the appropriate color of ink may be received in the four reservoir stalls. As seen in FIG. 9 one of the lockouts 270 has been removed to more clearly show the slots 272 in the frame in which the lockouts 270 are slideably received. Also note in FIG. 9 that the lockouts 270 each have vertically upstanding bosses 288 integrally formed thereon which, when the lockouts 270 are fully inserted into the slots 272 in the frame 72, provide an additional means of affixing the printed circuit board to the front of the upstanding flange 74 at the top of the reservoir connector frame.

It is thus seen that an easily replaceable ink delivery tube system has been provided which is uniquely useable with ink of a selected type, e.g. pigment based ink or dye based ink but not both, due to the lockouts 270 provided at the ink reservoir connector 70 and which is uniquely connectable to printheads of a selected color due to the lockout collars 148 on the printheads and the lockout posts 120–125 provided on the printhead connector 100. Removal of the entire system from the printer when it is desired to change from, e.g. pigment based ink to dye based ink, prevents fouling of the ink delivery system in a foolproof manner by inadvertent use of ink of the wrong type therein. The replacable delivery system is easily removed from the printer merely by disconnecting the air line and electrical connections at the reservoir connector 70 so that the reservoir connector can be removed from the printer, by removing the printheads from the carriage and then disconnecting the printhead connector 100 from the carriage 30 merely by squeezing the resilient finger tabs 102, 104 while pulling the printhead connector 100 from under the carriage 30 and by removing the ink delivery tube clip 130 from the rear tube guide 46 merely by sliding the bayonet connections to the proper direction for easy removal.

What is claimed is:

1. A replaceable ink delivery tube system for a large format printer comprising:

a) a plurality of flexible ink delivery tubes;

b) a printhead connector affixed to an ink delivery end of each of said tubes, said printhead connector having resilient finger engageable tabs thereon for attaching said printhead connector to a printer carriage, said tabs being engageable with recesses in said printer carriage, said printhead connector also having frangible lockout tabs thereon to permit connection of said printhead connector only to a mating printhead, selected ones of said tabs being removed whereby the remaining tabs are receivable in mating recesses on selected printheads to prevent incorrect printheads from being inadvertently attached to said printhead connector; and c) an ink reservoir connector affixed to an ink supply end of each of said tubes; said ink reservoir connector having lockout means thereon to permit connection of said ink reservoir connector only to ink reservoirs having mating lockout means thereon.

2. The replacement ink delivery system of claim 1, wherein said printhead connector is permanently attached to said ink delivery tubes.

3. The replaceable ink delivery tube system of claim 2, further comprising a protective sheath covering said ink delivery tubes for a length extending from said printhead connector for not less than one half of the length of said ink delivery tubes.

4. The replaceable ink delivery tube system of claim 3, further comprising a tube clip mounted on said ink delivery tubes at the end of said sheath remote from said printhead connector, said clip having means thereon for attaching said clip to a printer frame to hold said ink delivery tubes in position.

5. The replaceable ink delivery tube system of claim 3, wherein said flexible tubes are made of low density polyethylene.

6. The replaceable ink delivery system of claim 5, wherein said protective sheath is made of a polypropylene and EPDM compound.

7. The replaceable ink delivery tube system of claim 1, wherein said printhead connector is formed of plastic and said tabs are integrally formed with said printhead connector on oppositely facing sides of said printhead connector.

8. The replaceable ink delivery tube system of claim 7, further comprising guide means on said printhead connector for positioning said printhead connector and holding said printhead connector on said printhead carriage.

9. The replaceable ink delivery tube system of claim 1, wherein said reservoir connector comprises a frame having guides thereon for slideably positioning said reservoir connector in a printer such that said tubes extend from said reservoir connector at a rear side of said printer and such that a plurality of said ink reservoirs may be positioned from a front side of said printer in said reservoir connector into fluid connection with respective ones of said tubes.

10. The replaceable ink delivery tube system of claim 9, further comprising ink reservoir guide means and separate ink reservoir reception stalls in said reservoir connector, said guide means adapted for slideably guiding said ink reservoirs into said stalls to establish fluid connection of said reservoirs with said tubes.

11. The replaceable ink delivery tube system of claim 10, further comprising connector modules resiliently mounted in said frame and aligned with said stalls, said modules each including ink conduits extending therethrough, said conduits each having one end connectable to an ink tube and another end connectable to a said ink reservoir, said ink tubes being attached to said conduits at one side of said modules and having ink inlet ends in said stalls, said reservoirs being connectable to said ink inlet ends from a front side of said printer.

12. The replaceable ink delivery tube system of claim 11, wherein said connector modules each further include an air tube extending therethrough, said air tubes each being connected to a manifold mounted on said reservoir connector, said manifold having a quick release connector connectable to an air supply line, and said air lines having air connector ends which connect said reservoirs to said air lines as said reservoirs are positioned in said stalls.

13. The replaceable ink delivery tube system of claim 12, wherein said connector modules each further include electrical conductors extending therethrough, said electrical conductors being connected to a first electrical connector mounted on said frame, said first electrical connector being accessible from a rear side of said frame, and said modules having electrical contacts engageable with contacts on said reservoirs as said reservoirs are positioned in said stalls.

14. The replaceable ink delivery tube system of claim 13, further comprising electrical connectors resiliently mounted on said modules, said electrical connectors on said modules being connectable to electrical connectors on said ink reservoirs as said ink reservoirs are placed in said stalls in fluid communication with said ink tubes.

15. The replaceable ink delivery tube system of claim 13, wherein said modules are spring biased in said frame toward a front side of said printer.

16. The replaceable ink delivery tube system of claim 15, wherein said lockout means comprise lockout tabs on said frame extending into said stalls.

17. The replaceable ink delivery tube system of claim 16, wherein said lockout tabs are slidably received in guide tracks in said frame and are removable from said frame.

18. The printer of claim 11, wherein said connector modules each further include an air tube extending therethrough, said air tubes each being connected to a manifold mounted on said reservoir connector, said manifold having a quick release connector connectable to an air supply line, and said air lines having air connector ends which connect to said reservoirs to said air lines as said reservoirs are positioned in said stalls.

19. The printer of claim 18, wherein said connector modules each further include electrical conductors extending therethrough, said electrical conductors being connected to a first electrical connector mounted on said frame, said first electrical connector being accessible from a rear side of said frame, and said modules having electrical contacts engageable with contacts on said reservoirs as said reservoirs are positioned in said stalls.

20. The printer of claim 19, further comprising electrical connectors resiliently mounted on said modules, said electrical connectors on said modules being connectable to electrical connectors on said ink reservoirs as said ink reservoirs are placed in said stalls in fluid communication with said ink tubes.

21. The printer of claim 20, wherein said modules are spring biased in said frame toward a front side of said printer.

22. The printer of claim 21, wherein there are four stalls and modules in said frame.

23. The printer of claim 21, wherein said lockout means comprise lockout tabs on said frame extending into said stalls.

24. The printer of claim 23, wherein said lockout tabs are slidably received in guide tracks in said frame and are removable from said frame.

25. The replaceable ink delivery tube system of claim 9, further comprising quick release connector means on said reservoir connector accessible from a rear side of said printer for holding said reservoir connector in said printer.

26. A large format printer comprising:

a) a moveable printhead carriage having a plurality of printheads thereon;

b) a plurality of ink reservoirs on said printer; and c) a replaceable ink delivery tube system for delivering ink from said reservoirs to said printheads, said replaceable system comprising:

1) a plurality of bundled flexible ink delivery tubes;

2) a printhead connector affixed to an ink delivery end of each of said tubes, said printhead connector having resilient finger engageable tabs thereon attaching said printhead connector to said printhead carriage, said tabs being engageable with recesses in said printhead carriage, said printhead connector also having frangible lockout tabs thereon to permit connection of said printhead connector only to mating printheads, selected ones of said tabs being removed whereby the remaining tabs are received in mating recesses on selected printheads to prevent incorrect printheads from being inadvertently attached to said printhead connector; and 3) an ink reservoir connector affixed to an ink supply end of each of said tubes; said ink reservoir connector having lockout means thereon to permit connection of said ink reservoir connector only to ink reservoirs having mating lockout means thereon.

27. The printer of claim 26, wherein said printhead connector is permanently attached to said ink delivery tubes.

28. The printer of claim 26, wherein said printhead connector is formed of plastic and said tabs integrally are integrally formed with said printhead connector on oppositely facing sides of said printhead connector.

29. The printer of claim 28, further comprising guide means on said printhead connector for positioning said printhead connector and holding said printhead connector on said printhead carriage.

30. The printer of claim 26, wherein said reservoir connector comprises a frame having guides thereon for slideably positioning said reservoir connector in said printer such that said tubes extend from said reservoir connector at a rear side of said printer and such that a plurality of ink reservoirs may be positioned from a front side of said printer in said reservoir connector into fluid connection with respective ones of said tubes.

31. The printer of claim 30, further comprising quick release connector means on said reservoir connector accessible from a rear side of said printer for holding said reservoir connector in said printer.

32. The printer of claim 31, further comprising ink reservoir guide means and separate ink reservoir reception stalls in said reservoir connector, said guide means adapted for slideably guiding said ink reservoirs into said stalls to establish fluid connection of said reservoirs with said tubes.

33. The printer of claim 32, further comprising connector modules resiliently mounted in said frame and aligned with said stalls, said modules each including ink conduits extending therethrough, said conduits each having one end connectable to an ink tube and another end connectable to a said ink reservoir, said ink tubes being attached to said conduits at one side of said modules and having ink inlet ends in said stalls, said reservoirs being connectable to said ink inlet ends from a front side of said printer.

34. The printer of claim 26, further comprising a protective sheath covering said ink delivery tubes for a length extending from said printhead connector for not less than one half of the length of said ink delivery tubes.

35. The printer of claim 34, further comprising a tube clip mounted on said ink delivery tubes at the end of said sheath remote from said printhead connector, said clip having means thereon for attaching said clip to printer frame structure to hold said ink delivery tubes in position.

36. The printer of claim 34, wherein said flexible tubes are made of low density polyethylene.

37. The printer of claim 36, wherein said protective sheath is made of a polypropylene and EPDM compound.

* * * * *